US008713905B1

(12) United States Patent
Branscomb

(10) Patent No.: US 8,713,905 B1
(45) Date of Patent: May 6, 2014

(54) BRAIDED EYE SPLICE AND METHOD

(71) Applicant: David John Branscomb, Auburn, AL (US)

(72) Inventor: David John Branscomb, Auburn, AL (US)

( * ) Notice: Subject to any disclaimer, the term of this patent is extended or adjusted under 35 U.S.C. 154(b) by 0 days.

(21) Appl. No.: 13/669,408

(22) Filed: Nov. 5, 2012

(51) Int. Cl.
*B65H 69/06* (2006.01)

(52) U.S. Cl.
USPC ..... 57/22; 57/202

(58) Field of Classification Search
USPC ..... 57/22, 202
See application file for complete search history.

(56) References Cited

U.S. PATENT DOCUMENTS

| | | | | | |
|---|---|---|---|---|---|
| 2,463,199 | A * | 3/1949 | Peterson | ..... | 57/202 |
| 2,943,434 | A * | 7/1960 | Joy et al. | ..... | 57/202 |
| 3,204,519 | A * | 9/1965 | Lawson et al. | ..... | 87/8 |
| 3,411,400 | A * | 11/1968 | Morieras et al. | ..... | 87/8 |
| 3,537,742 | A * | 11/1970 | Black | ..... | 294/74 |
| 4,058,049 | A * | 11/1977 | Bech | ..... | 87/8 |
| 4,114,360 | A * | 9/1978 | Emmons | ..... | 57/202 |
| 6,575,072 | B2 * | 6/2003 | Pellerin | ..... | 87/6 |
| 2012/0266583 | A1 * | 10/2012 | Crozier et al. | ..... | 57/202 |

* cited by examiner

*Primary Examiner* — Shaun R Hurley
(74) *Attorney, Agent, or Firm* — Jon David Jackson

(57) ABSTRACT

A braided eye splice is presented that is formed with the braider yarns of the rope, in which the braider yarns are braided back into the rope. A braided section of rope may be used as a braider yarn or combined with another braider yarn to form the splice. The tensile failure of ropes made with this splice occurs outside the spliced section, suggesting that full rope strength is maintained.

4 Claims, 3 Drawing Sheets

BRAIDED EYE SPLICE AND METHOD

BACKGROUND OF THE INVENTION

1. Field of the Invention

This invention relates to the field of splices and spliced ropes, and the method of splicing.

2. Description of Related Art

Rope has many uses today from materials handling and marine to aerospace to sports. Evidence of short handmade ropes dates back to prehistoric cultures. These early ropes were made by twisting natural fibers. However as the shipping and marine industry expanded, longer and stronger ropes were needed. Eventually, ropes came to be made from higher quality materials such as nylon and polyester. Today, some ropes are still twisted, but many are braided.

To make ropes more useable, many people add knots. However, knots cause the rope to lose much of its strength. This loss of strength is due to a more concentrated area of strain. A special kind of knot that allows the rope to retain more of its strength is the splice. Splices make a more permanent fastening than knots and spread the stress through a larger area than a knot. Yet, commonly used splices do not allow the rope to retain all of its original strength.

For example, a commonly used splice known as a buried eye splice is made by threading the free end of a rope back through the hollow core of the rope. As the rope is pushed through itself, an eye is formed. When this splice is under tension, the rope and splice act like a Chinese finger trap. This means that the rope acts like the finger trap and gets tighter under tension preventing the splice from being pulled out. The buried eye splice generally experiences some loss of strength and requires a hollow rope.

Braided loops are an ancient discovery and obviously follow the invention of the rope as a necessity for usefulness. The patent literature has a multitude of applications involving loops in ropes of various sorts. Splices which closest represent the structure presented here are included in this section.

Some slings have been made on the same principle of re-braiding the material; however these are distinct, in the fact that they do not reintroduce the braided material into the braid. They braid a section, leave a section unbraided and then re-combine by braiding. These braids could be weaker due to the increased stresses in such connections for the same amount of material.

In U.S. Pat. No. 3,583,749, titled "Rope Assembly," an eye splice is described. The splice is removable and able to be reattached; however, it is unlikely that the strength of the splice is equal to the strength of the rope.

Another U.S. Pat. No. 4,036,101, entitled "Double Hollow braided rope assembly and method," uses a similar technique to form a loop or splice, except it requires multiple ropes braided over one another. Also, it is not demonstrated that the strength of said loops will be as strong as the strength of the rope.

U.S. Pat. No. 2,600,395 depicts another splice, but requires a needle to penetrate through the material. This penetration can potentially weaken the splice. The present invention is comprised of the same type of splice but without cutting or penetrating any material, and with up to 100% of the strength of the rope.

The braided loop described herein is a viable way to produce usable terminations in tethers and other rope configurations. Although, knots, loops and other rope or cord terminations are typically weaker than the rope itself, a braided loop that has approximately twice the amount of material should improve the holding properties of an inherently weak section.

This configuration is the opposite of most "slings", which in some cases have half the material for the rope and thus require half the material to produce the loop. So, the braided structure presented in this report should be lighter than its traditional sling counterpart, in addition stronger.

BRIEF SUMMARY OF THE INVENTION

The new, braided splice presented is incorporated into a rope using a braiding machine. This design allows for a stronger splice which is unable to be pulled out under tension. Under testing, the braided splice design that was found to yield the highest strength never failed within the spliced region. A stronger splice made from rope means that they can be used for heavier loads, and they would not have to be replaced as often because they would be more durable.

BRIEF DESCRIPTION OF THE DRAWINGS

FIG. 2 shows a splice being made, with a loop in the middle section, braider yarns oriented toward a braiding machine, and the braided end also moving toward the braiding machine.

DETAILED DESCRIPTION OF THE INVENTION

Figure 1:
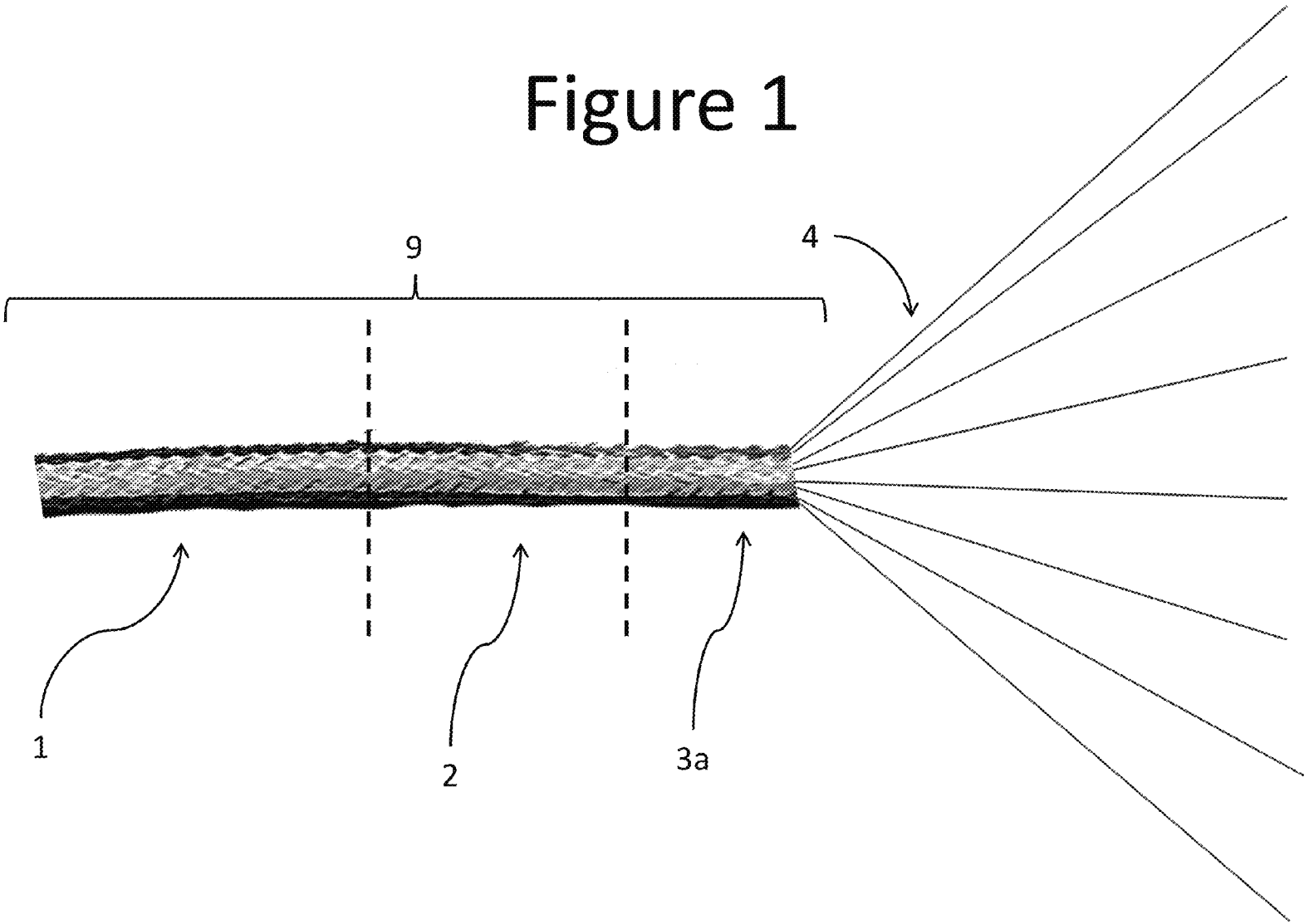
FIG. 1 shows a short braided section of rope.

Looking at FIG. 1, the method begins by braiding an initial length of rope (9). This length will be utilized for three different functions, and will need to be long enough to serve all those purposes. For our samples, approximately two feet was long enough, but the length is not critical and will depend on the application and on how the machine is set up. First, the end of the braid will become a tail (1)—excess material as needed in the manufacturing process. Second, a length of the braid is designated to be braided back into the rope as a braided yarn (2). Third, the last part of the initial braid is the material that will form the eye (3*a*). Also visible in FIG. 1, a plurality of individual braider yarns (4) is directed back toward a braiding machine.

Looking next at FIG. 2, after the initial braided length (9) is sufficiently long, it is looped around to form the eye (3*b*). The eye is held in place while the braided yarn (2) is made ready to be braided with the individual yarns (4). This can be done in two different ways.

Figure 2A:
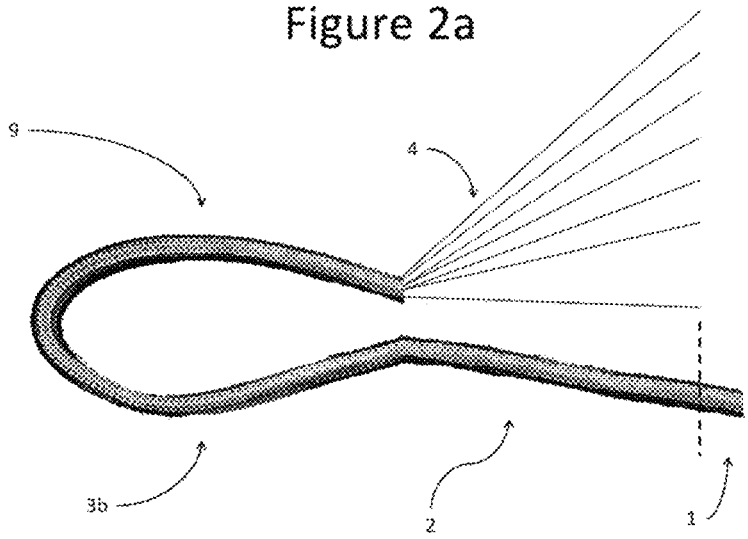
FIG. 2*a* shows one yarn removed and replaced in the splice by the larger braided yarn.

First, looking at FIG. 2*a*, one of the individual yarns (4) is cut and replaced temporarily by the braided yarn (2). The figures depict eight individual yarns (4), although the invention has been made with varying numbers of individual yarns. Looking closely at FIG. 2*a*, only seven individual yarns (4) are present. The eighth is replaced by the braided yarn (2). Note that all eight of the individual yarns (4) are present in the braided yarn (2), which will now be braided back into the seven remaining individual yarns (4). More generally, for a rope with n yarns (4), the splice is to be formed with one braided yarn (2) and n−1 individual yarns.

Figure 2B:
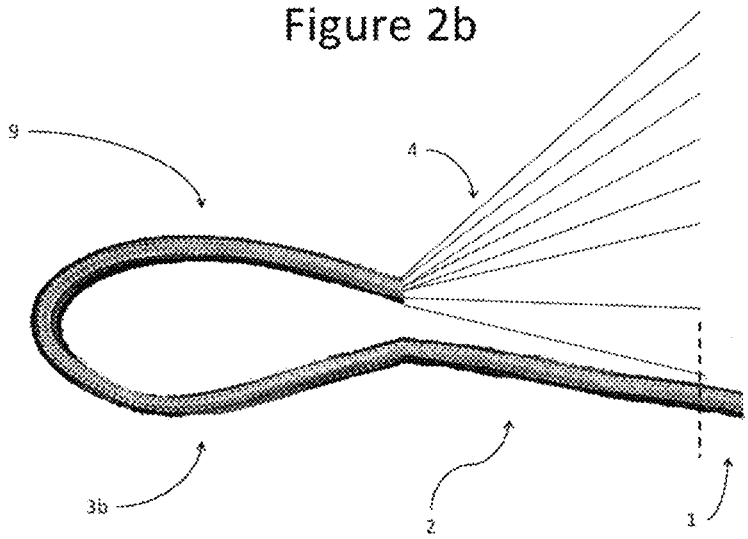
FIG. 2*b* shows all yarns retained, and simply adds the braided yarn.

Looking now at FIG. 2*b*, we see a possible alternative. If an additional carrier is available, the braided yarn can be wound around an additional bobbin so that there is no loss of material. Again using the example of a rope with eight yarns, it is apparent in FIG. 2*b* that all eight individual yarns (4) are present in addition to the braided yarn (2). For a rope of n yarns (4), the splice contains n+1 yarns, which includes one braided yarn (2) and n individual yarns (4). This requires a braiding machine of larger capacity than the rope being braided, or a modified carrier; in the example of an eight-yarn rope, a ninth bobbin will be needed. For example, ropes produced in this way may contain 16 individual yarns (4) and be braided on a machine with 32 carriers, with many carriers not loaded.

Figure 3:
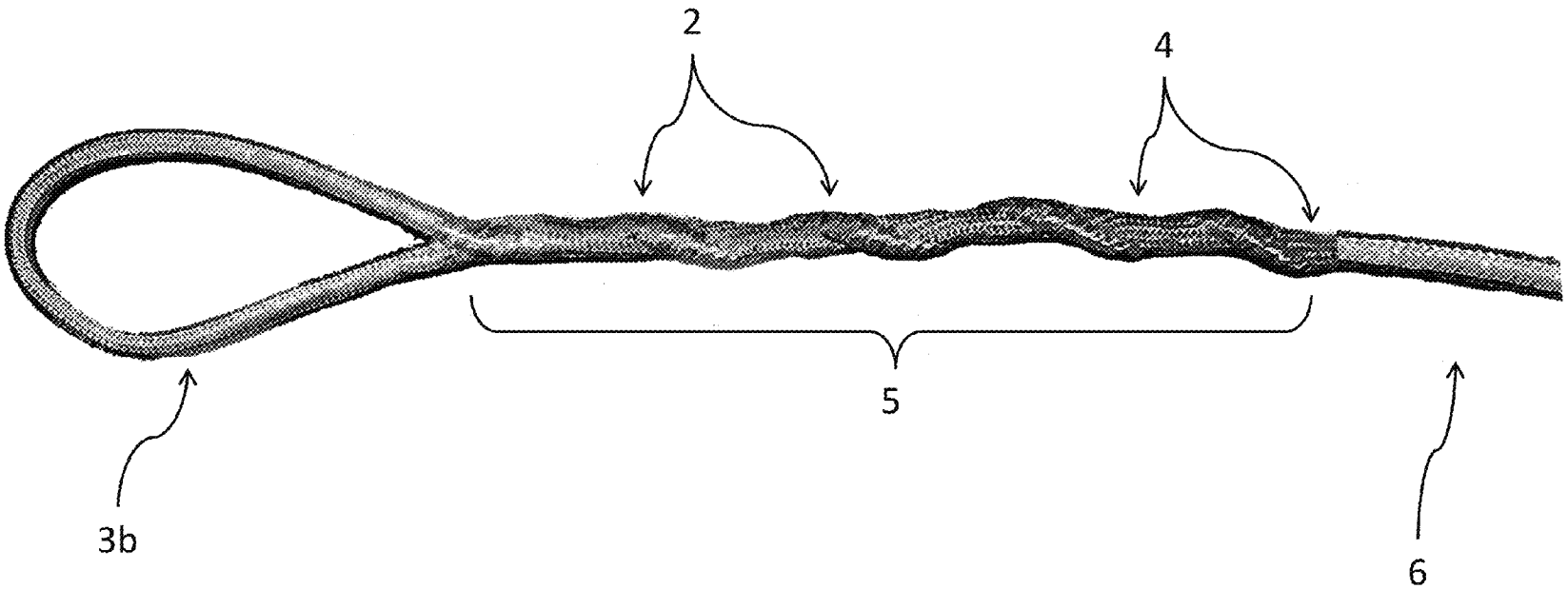
FIG. 3 shows the braided splice.

Moving now to FIG. 3, once the braided yarn (2) is in place, the braiding resumes and the splice (5) is formed. The braided yarn (2) is the dominating element in the formation of the splice (5), as can be seen in the predominantly helical shape of the splice (5). The braided yarn (2) is braided with the individual yarns (4) sufficiently far so that it will not slip; this desired length makes up the splice (5). After the splice (5) is the desired length, and the specified length of the braided yarn (5) is braided, the extra material in the tail (1) is cut off. Any additional material left in the tail can be braided over in the rope (6). After the tail (1) is cut off, the braiding process resumes producing the rope (6). It is noted that if a yarn (4) is removed as in FIG. 2*a*, that yarn will at this time be spliced back into the rope (6).

I claim:

1. A method for producing a braided eye splice, comprising the steps of braiding a length of rope using a plurality of individual yarns which will comprise a tail, a braided yarn, and material to form an eye, looping the braided material into said eye, holding the eye while replacing one individual yarn with said braided yarn and said tail, braiding remaining individual yarns and said braided yarn into a splice of sufficient length not to slip, cutting off said tail, reintroducing said one individual yarn into braid.

2. A method for producing a braided eye splice, comprising the steps of braiding a length of rope using a plurality of individual yarns which will comprise a tail, a braided yarn, and material to form an eye, looping the braided material into said eye, holding the eye while preparing braided yarn to braid into said individual yarns, braiding said individual yarns and said braided yarn into a splice of sufficient length not to slip, cutting off said tail.

3. A splice made by a process comprising the steps of braiding a length of rope using a plurality of individual yarns which will comprise a tail, a braided yarn, and material to form an eye, looping the braided material into said eye, holding the eye while replacing one individual yarn with said braided yarn and said tail, braiding remaining individual yarns and said braided yarn into a splice of sufficient length not to slip, cutting off said tail, reintroducing said one individual yarn into braid.

4. A splice made by a process comprising the steps of braiding a length of rope using a plurality of individual yarns which will comprise a tail, a braided yarn, and material to form an eye, looping the braided material into said eye, holding the eye while preparing braided yarn to braid into said individual yarns, braiding said individual yarns and said braided yarn into a splice of sufficient length not to slip, cutting off said tail.

* * * * *